US005424160A

United States Patent [19]

Smith et al.

[11] Patent Number: 5,424,160

[45] Date of Patent: Jun. 13, 1995

[54] CONDUCTIVE CARRIER COATINGS AND PROCESSES FOR THE PERFECTION THEREOF

[75] Inventors: Thomas W. Smith, Penfield; David J. Luca, Rochester; Michael J. Duggan, Webster; John A. Creatura, Ontario, all of N.Y.

[73] Assignee: Xerox Corporation, Stamford, Conn.

[21] Appl. No.: 268,387

[22] Filed: Jun. 29, 1994

[51] Int. Cl.[6] ..... G03G 9/113

[52] U.S. Cl. ..... 430/108; 428/407

[58] Field of Search ..... 430/108; 428/407

[56] References Cited

U.S. PATENT DOCUMENTS 4,937,166 6/1990 Creatura et al. ..... 430/108
5,002,846 3/1991 Creatura et al. ..... 430/108
5,015,550 5/1991 Creatura et al. ..... 430/108
5,102,769 4/1992 Creatura ..... 430/137
5,256,511 10/1993 Matsumura et al. ..... 430/108

FOREIGN PATENT DOCUMENTS 40472 2/1992 Japan ..... 430/108

*Primary Examiner*—Roland Martin
*Attorney, Agent, or Firm*—John L. Haack

[57] ABSTRACT

A carrier composition comprised of a core with a coating thereover comprised of a composite comprised of a conductive aromatic or heteroaromatic polymer comprised of a monomer or monomers selected from the group consisting of pyrrole, indole, thiophene, thianaphthene, indene, azulene and ring pendant substitutent derivatives thereof; and a fluoropolymer host resin.

13 Claims, 3 Drawing Sheets

CONDUCTIVE CARRIER COATINGS AND PROCESSES FOR THE PERFECTION THEREOF

CROSS REFERENCE TO COPENDING APPLICATIONS AND ISSUED PATENTS

Attention is directed to application U.S. Ser. No. 07/176,187 (D/93298) filed Jan. 3, 1994, entitled "CONDUCTIVE POLYMERIC COMPOSITES, ARTICLES AND PROCESSES FOR THE PREPARATION THEREOF" and U.S. Ser. No. 07/896,035 (D/91425) filed Jun. 9, 1992, entitled "CHARGE PINNING IN NEGATIVE CHARGING TONERS WITH IONOPHORIC AND IONOMERIC BLOCK COPOLYMERS", the disclosures of which are incorporated by reference herein in their entirety.

Attention is directed to issued U.S. Pat. Nos. 4,592,989 (D/83061) entitled "TONER COMPOSITIONS CONTAINING COMPLEX IONOPHORIC POLYMERIC MATERIALS", and 5,102,763 (D/89066) entitled "COLOR TONER COMPOSITIONS ENABLED BY COLORED SILICAS WITH ADSORBED IONOPHORIC DIBLOCK COPOLYMERS", the disclosures of which are incorporated by reference herein in its entirety.

BACKGROUND OF THE INVENTION

The present invention is generally directed to processes for the preparation of conductive polymeric coatings and articles thereof, and more specifically to carrier and developer compositions treated with the conductive coatings, by for example, a dry powder process, for use in two component electrophotographic imaging processes. In embodiments of the present invention, carrier particles are comprised of a core with a conductive coating thereover generated from colloidal powders comprised of intrinsically conducting polymers which reside in the interstices of the amorphous regions of fluorinated polymers. The conductive colloidal powders are prepared by solubilizing concentrated ionic solutions, of for example, about 10 to about 75 percent by weight of a redox salt, in the amorphous regions of commercially available fluorinated polymers and related resins, such as polyvinylidene difluoride ($PVF_2$). Subsequent exposure of the solubilized redox salt and fluoropolymer mixture to the vapor of a redox polymerizable monomer or a solution of a redox polymerizable monomer in a non solvent for $PVF_2$ and the ionic redox salt, results in the rapid formation of intrinsically conducting polymers (ICPs) interstitially in the amorphous regions of the $PVF_2$ powder. An essential particulate characteristic of the $PVF_2$ powder is retained throughout this process, thus enabling the facile isolation of conductive colloidal-sized product particles that are suitable for direct thermal powder coating onto carrier particles. More specifically, the present invention is directed to conductive colloidal polymeric powder compositions containing therein, known conductive aromatic and heteroaromatic polymers, for example, poly(pyrrole), poly(thiophene) or poly(azulene) and their congeners, and which compositions are interstitially polymerized in the amorphous regions of fluorinated polymer resins.

Intrinsically conducting polymers or ICPs and composites of one or more ICP and a host polymer are known and have been described, reference for example, the aforementioned copending application, U.S. Ser. No. 07/176,187 (D/93298) filed Jan. 3, 1994, and references cited therein. However, applications of these materials have been limited by poor processability characteristics and low thermal and oxidative stability. Further, there is disclosed in the aforementioned copending application a composition comprised of a conductive composite comprised of an aromatic or heteroaromatic polymer comprised of monomer or monomers selected from the group consisting of pyrrole, indole, thiophene, thianaphthene, indene, azulene and ring pendant substitutent derivatives thereof; and a block or graft copolymer selected from the group consisting of ionophoric and ionomeric copolymers wherein the block or graft copolymer has at least one apolar segment and at least one ion binding segment, and processes for the preparation of said conductive composites.

Conductive magnetic brush (CMB) development systems are known in the art and provide for efficient, reliable, and cost effective xerographic development means. These systems have been prepared through powder coating by partially coating conductive carrier cores with electropositive or electronegative polymers to provide a balance of control over conductivity and tribo charging characteristics, for example, as disclosed in U.S. Pat. No. 5,015,550, issued May 14, 1991 to Creatura et al. CMB carriers have also been obtained by solution coating of mixtures of polymers and conductive particles, typically carbon black, onto various conductive and insulative carrier cores to yield developers of controlled conductivity, for example, as disclosed in U.S. Pat. No. 5,102,769, issued Apr. 7, 1992 to Creatura. Submicron polymer/carbon black composites particles prepared by suspension polymerization techniques have also proven useful in the preparation of CMB carriers by powder coating processes as disclosed in, for example, U.S. Pat. No. 5,236,629, issued Aug. 17, 1993, to Mahabadi et al. The CMB carriers obtained through partial coating provide a limited range of control over conductivity and tribo, moreover, these systems may be more humidity sensitive than fully coated carriers and may not yield tribo and conductivity stability over extended periods of time, due to impaction of toner onto the uncoated areas of the carrier core. Solution coating of polymer/conductive particle mixtures can yield the required conductivity and developer life characteristics, however, their preparation is complicated by the requirement of controlling the emission of volatile organic compounds into the environment. Suspension polymerized resin carbon black composites have provided effective, conductive electropositive materials, reference the aforementioned U.S. Pat. No. 5,236,629. However, there continues to be a need for electronegative conductive composites in the form of submicron particles suitable for powder coating.

Fluoropolymers such as the aforementioned $PVF_2$ materials are ideal electronegative polymers but they are not readily amenable to suspension polymerization processes because of their gaseous character of the monomer and limited solubility and dispersibility characteristics of the polymer.

A preferred process for preparing carrier particles is by powder coating processes, reference for example, U.S. Pat. No. 4,937,166, issued Jun. 26, 1990, to Creatura et al., wherein, for example, a carrier composition comprised of a core with a coating thereover comprised of a mixture of first and second polymer resins that are not in close proximity thereto in the triboelectric series is described. That is, one polymer is electropositive and imparts a negative triboelectric charge to the toner, and the second polymer is electronegative and imparts a positive triboelectric charge to the toner. The resulting developer has a triboelectric value which is intermediate between the electropolarity imparted by the first and second resins.

When a carrier coating or composition with different triboelectric characteristics is desired, different batch processing conditions must be employed and may require considerable experimental trial and error to arrive at a desired coating composition and process conditions.

Environmental instability, lack of mechanical strength and integrity, and difficulties in processing have represented major barriers to commercial application of intrinsically conducting organic polymers. Among ICPs, poly(pyrroles) and poly(thiophenes) are acknowledged to be among the most environmentally stable. Their synthesis is relatively simple. Developmental activities seeking to exploit commercial applications of intrinsically conducting polymers have focused on improved processing and mechanical integrity in these materials. Poly(thiophenes)and poly(pyrroles) obtained by conventional processes are typically intractable, see for example, *Advanced Materials,* Volume 5, Number 9, September 1993, Part 2, page 646 to 650. Thus, there remains a need for highly conducting, environmentally stable and easily processable polymer composite materials.

There also remains a need for conductive colloidal materials, particularly negative contrast materials, that are suitable for use in known thermal powder coating processes and that can be used in preparing conductive carrier coatings.

The present invention provides melt processable, electronically conducting or semiconducting thermoplastic composites of intrinsically conducting organic polymers that are polymerized within the amorphous regions of certain fluorinated polymers. The present invention further specifies processes for the preparation of these conductive composites and provides processes for making electrically conductive carrier coatings and xerographic developers therefrom.

The composite compositions of present invention are prepared in embodiments, by in situ polymerization of aromatic and heteroaromatic monomers such as thiophene, pyrrole, indole, indene, and azulene, or a congener, for example, 3-methyl pyrrole, bithiophene, 3-alkylthiophenes, thianapththene, and the like, in the presence of at least one fluorinated polymer.

The present invention, in embodiments, overcomes the performance and processability problems associated with the ICP compositions of the prior art by forming melt processable, submicron composite particles comprised of a conducting aromatic or heteroaromatic polymer and a fluoropolymer. The conductivity of the composite can be readily controlled by variation of the ICP and/or its amount and distribution in the composite particles. The present invention provides polymeric composite compositions which are, melt processable, and exhibit specific stable and controllable levels of conductivity. The composite particles are particularly well suited for powder coating applications.

SUMMARY OF THE INVENTION

It is an object of the present invention to overcome the above discussed problems in the prior art.

It is another object of the present invention to provide conductive polymeric composite compositions or intrinsically conducting organic polymer (ICP) in combination with a fluoropolymer host resin with controlled electrical conductivity properties.

It is a further object of the present invention to provide ICP composite compositions which are readily processed in the melt and are particularly suitable for powder coatings.

It is another object of the present invention to provide ICP fluoropolymer composite compositions and coatings thereof which are environmentally stable and greatly resist the effects of moisture, oxygen, and heat.

It is another object of the present invention to provide interstitial ICP fluoropolymer composite compositions which are processable by melt means such as extrusion, melt mixing, molding, or thermal powder coating.

It is an additional object of the present invention to provide ICP fluoropolymer composite compositions possessing a range of conductivity properties.

Additional objects and advantages of the invention will be apparent to those skilled in the art from the descriptions of compositions and processes for the preparation thereof which follow.

These and other objects of the present invention are accomplished in embodiments by providing a conductive xerographic carrier composition comprising: carrier core particles with a coating thereover comprised of a composite comprised of an aromatic or heteroaromatic polymer comprised of a monomer or monomers selected from the group consisting of pyrrole, indole, thiophene, thianaphthene, indene, azulene and ring pendant substitutent derivatives thereof; and a fluoropolymer selected from polyvinylidene difluoride, and related fluoropolymers disclosed herein. The present invention also provides in embodiments, processes for the preparation of conductive composite coated carrier particles comprising: mixing carrier core particles with the above mentioned conductive powdered polymeric composite composition in an amount of from about 0.25 to about 5.0 percent by weight of the conductive composite for a sufficient period of time to enable the polymer composite to physically adhere to the carrier core particles; heating the mixture of carrier core particles and composite polymer to a temperature of about 200° F. to about 550° F., whereby the conductive composite polymer mixture melts and fuses to the carrier core particles; and thereafter cooling the resulting coated carrier particles.

In embodiments of the present invention, environmentally stable ICP/$PVF_2$ composites are prepared and applied to the surface of carrier particles to form uniformly coated carrier compositions with desirable triboelectric and conductivity properties.

The processes and compositions formed thereby, of the present invention can be utilized to produce xerographic developers which provide for high reliability and high fidelity two component and conductive magnetic brush development imaging processes. The conductive carrier coatings and coated carrier particles of the present invention, in embodiments, provide environmentally stable developers which resist known developer aging phenomena, for example, humidity, oxygen sensitivity, and thermal degradation of developer performance.

In embodiments of the present invention are provided processes for the preparation of electrically conductive polymeric composite compositions comprising: 1.) imbibing colloidal fluoropolymer particles suspended in a polar protic or polar aprotic solvent with a soluble redox metal halide salt or related non-halide metal salt to form a gelatinous slurry; 2.) removing excess solvent and unimbibed soluble salt, for example, by filtration or centrifugation to form a gel; 3.) drying the gel to form a powder; 4.) suspending the resultant powder in a nonpolar aprotic solvent; 5.) adding at least one aromatic or heteroaromatic monomer selected from the group consisting of pyrrole, indole, thiophene, thianaphthene, indene, azulene, ring substitutent derivatives thereof, and the like, to the resulting suspension to form in situ an intrinsically conducting polymer; 6.) removing excess nonpolar solvent and unpolymerized monomer to afford a wet cake; 7.) washing or extracting the wet cake with an organic solvent to remove residual metal salt ions; and optionally 8.) drying, grinding, and sieving to afford the conductive powdered composite. Optionally, there may be accomplished prior to the optional drying grinding, and sieving steps an ion exchange with a solution of counter ions desired for compensation of the radical cation sites occurring in the fractionally oxidized ICP, which sites are formed spontaneously on polymerization of the heterocyclic or aromatic monomer. Another procedural option is to react the gel after step 2 with aromatic or heteroaromatic monomer followed by diluting with toluene as necessary to produce a gelatinous slurry. This generally results in a composite of lower conductivity.

From numerous preparations of the ICP/-fluoropolymer composites of the present invention and ion exchange studies, it was determined that the relation of the counter ion to the oxidized radical cation sites in the ICP, plays a important role in controlling the humidity sensitivity and the thermal stability of the conductivity of the composite composition and of the resultant carrier and developer compositions. Although not desired to be limited by theory, it believed that, in addition to the nature of the ICP itself, at least four other factors appear to be important in determining the environmental stability of $PVF_2$/ICP composites. These factors appear to be: the polarizability of the anion derived from the redox metal salt or redox agent; the strength of the conjugate acid; the reactivity of the anion; and the nature of the substitutents, if any, bonded to the anion. Polarizability of the anion is defined by the known Hard Soft Acid Base (HSAB) theory. Hard anions, such as $R(Ar)SO_3$—, $R(Ar)CO_2$—, ArO—, $ROPO_3H$—, and the like, where R is, for example, a linear or branched hydrocarbon chain having from about 5 to about 20 carbon atoms, are preferred over soft anions, such as Cl—, Br—, I—, SCN—, and the like. Anions with strong conjugate acids are preferred, for example, trifiic acid ($CF_3SO_3H$), trifluoroacetic acid, para-toluene sulfonic acid, alkylaryl sulfonic acids, alkylaryl phosphonic acids or acid esters, polysulfonated aromatics, and the like. Non oxidizing anions, such as those listed above are preferred whereas oxidizing anions such as $ClO_4$—, $NO_3$—, and the like, are less preferred or are to be avoided. Preferred substitutents bonded to the anion are hydrophobic and are selected from the group consisting of alkyl, aryl, and arylalkyl substitutents with from 6 to about 20 carbon atoms. The stability of poly(thiophene) and poly(pyrrole) to elevated temperatures, long term aging, oxidative degradation and high humidity appears to be dependent on the nature of the anions, which anions are believed to compensate the radical cation sites in the fractionally oxidized ICP. The accompanying fragmentary chemical structure is exemplary of the ICP compounds of the present invention

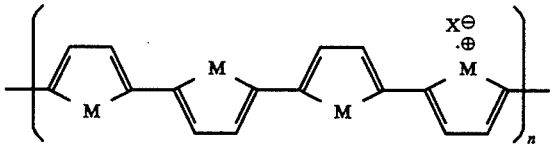

wherein M is a heteroatom selected from the group consisting of, for example, nitrogen (N) and sulfur (S), illustrated herein, X is a counter anion which is preferably a "hard" anion, n is an integer of from 10 to about 100,000 representing the active or conductive ICP fragment species that comprise the intrisically conducting polymeric materials.

In embodiments of the present invention, preferred anions associated with the ICP may be introduced into the solvent swollen and reduced salt-fluoropolymer composite precursor by ion exchange means as detailed in the optional steps to the general preparative process in Example II and results tabulated in Table 1. It was also determined that chloride ion, Cl—, and tetrachloroferrate ion, ($FeCl_4$)—, were less than optimal as residual ions in both poly(pyrrole), because of lower temperature stability, and in poly(thiophene), because of the degradation of the ICP at elevated temperatures and under higher humidity conditions. Preferred redox active cations include $Fe^{3+}$, $Sn^{4+}$, $Ce^{4+}$, $Ru^{3+}$, $Os^{3+}$, $Cu^{2+}$, and the like. Preferred redox active anions are, for example, ferricyanide, peroxy disulfate, and iodate.

In embodiments of the present invention, there are provided processes for the preparation of conductive fluoropolymer composite powders which are melt processable, and which powders are thermally and oxidatively stable to melt processing conditions. The present invention in embodiments, also enables the ICP composites prepared from submicron $PVF_2$ powders that retain a colloidal size characteristic, typically less than about 1 micron in diameter when dispersed in a host resin and when powder coated and thermally adhered to carrier core particles. This is believed to be an important feature of polymeric materials used in the processes of the present invention of thermal power coating for preparing conductive magnetic brush carrier particles described hereinafter. The present invention, in embodiments, requires selective solubilization of the amorphous regions of the semi-crystalline fluoropolymer resin by the redox salt solution. The redox salt solution is prepared with a solvent or solvent mixture which substantially dissolves all the redox salt compound but is essentially non dissolving or is a non solvent for the fluoropolymer in the absence of the metal salt or redox agent. For example, methanol is poorly adsorbed into colloidal $PVF_2$ powders, whereas concentrated solutions of $FeCl_3$ in methanol are extensively imbibed, as indicated in the working Examples and FIG. 3. Examples of preferred solvents for forming the salt solution complexes of the present invention are selected from the group consisting of methanol, ethanol, isopropanol, ethyl ether, glyme, diglyme, ethyl acetate, isopropyl acetate, CELLOSOLVE®, CELLOSOLVE ACETATE® and the like, and mixtures thereof. The salt solutions of the present invention are prepared in concentrations over a range of from about 10 to about 75 weight percent of the salt to the total weight of the solvent. In an exemplary example, a 50 percent methanol solution of $FeCl_3.(H_2O)_6$ strongly solvates the amorphous regions in a $PVF_2$ powder (KYNAR ®301 F) to yield a gelatinous powder containing with about 34 percent by weight of the salt solution. In another exemplary example, a 33 percent solution as above has a slightly lower solvating strength, but still provides a gelatinous powder complex product containing about 21 percent by weight of the salt solution. Other known nonsolvents for fluoropolymers, and particularly for $PVF_2$, which are capable of dissolving ionic salts can also be selected. Accordingly, a 25 weight percent solution of $FeCl_3$ in diethyl ether, glyme or diglyme, solvates the amorphous regions in $PVF_2$ forming gelatinous powders similar to those obtained with the aforementioned methanolic $FeCl_3$ solutions. That the salt solutions only solvate the amorphous regions is believed to be important to retaining the colloidal characteristic of the original $PVF_2$ powder in the polymeric composite products.

When the anion or cation of the redox salt, dissolved in the nonsolvent for $PVF_2$, is redox active and capable of catalyzing oxidative coupling polymerization reactions of the heteroaromatic monomers, such as pyrrole or thiophene, and their cogeners, intrinsically conducting polymers are formed interstitially in the amorphous regions of the $PVF_2$ powder. Appropriate redox agent cations include, for example, $Fe^{3+}$, $Sn^{4+}$, $Ce^{4+}$, $Ru^{3+}$, $Os^{3+}$, $Cu^{2+}$, and the like. Suitable redox agent anions include peroxydisulfate, iodate, and ferricyanide, and the like. Appropriate redox polymerizable monomers include pyrrole, 3-methylpyrrole, indole, thiophene, bithiophene, 3-methyl thiophene, and the like and mixtures thereof.

DETAILED DESCRIPTION OF PREFERRED EMBODIMENTS

Figure 1:
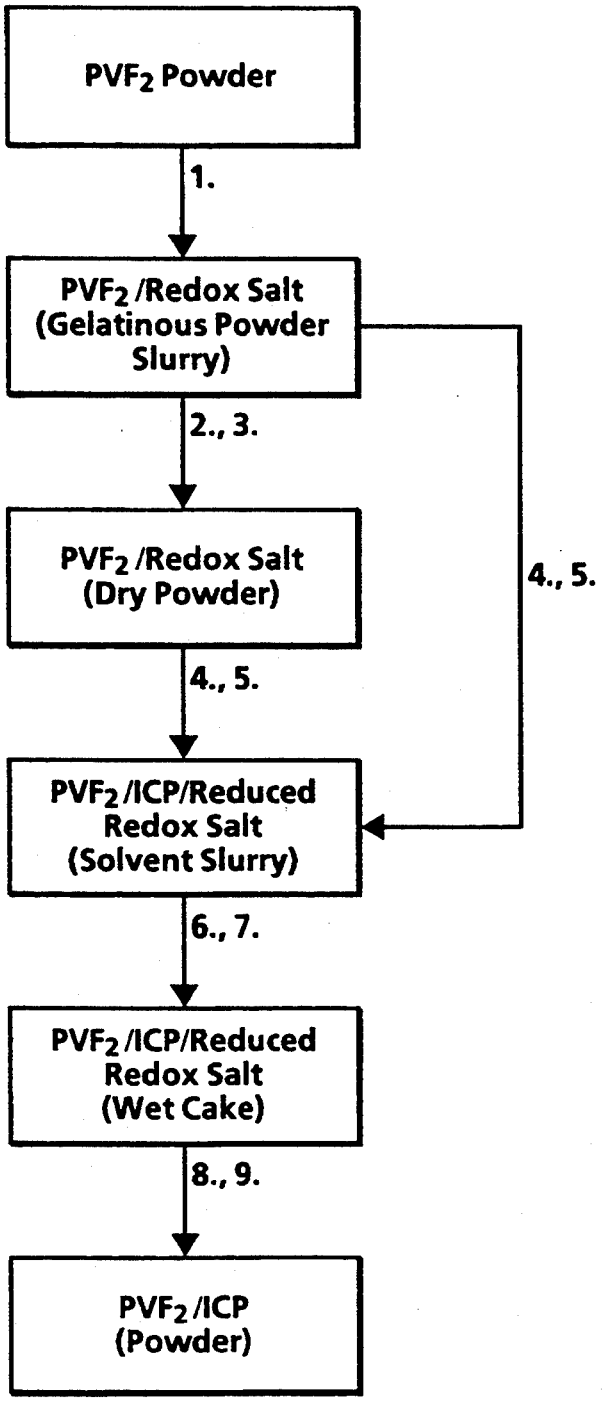
FIG. 1 is a flow chart that shows, in embodiments, exemplary process schemes for forming the powdered conductive composites of the present invention.
Figure 2:
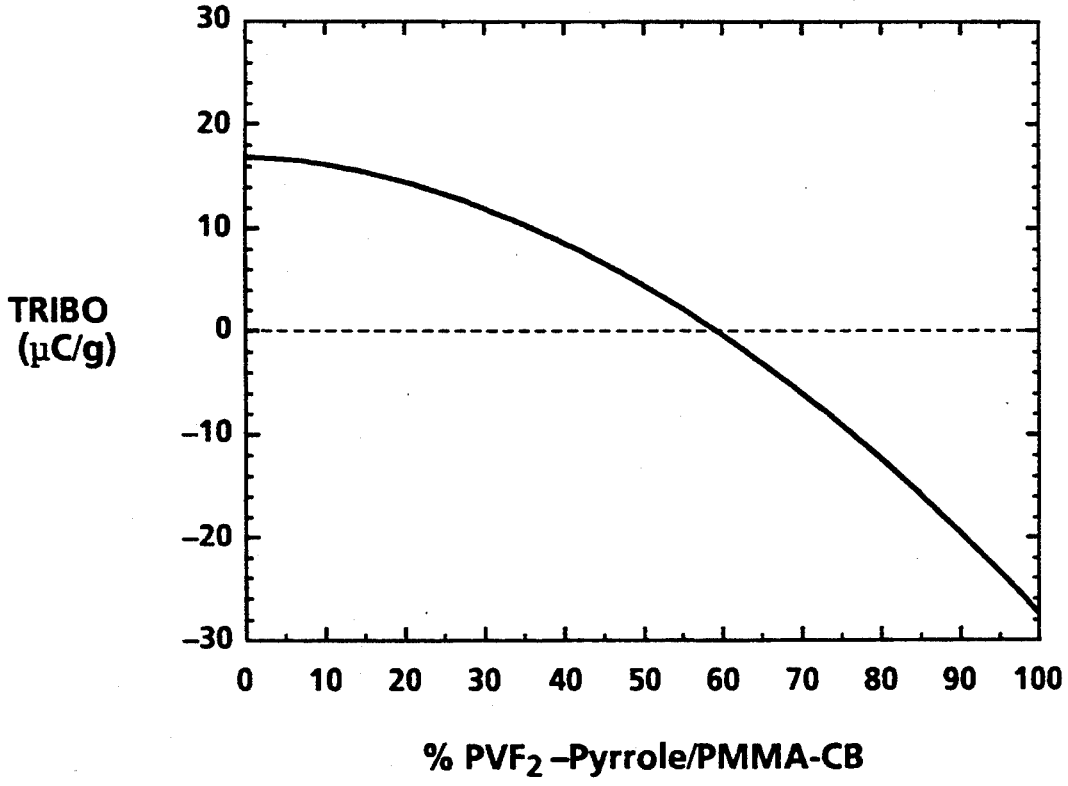
FIG. 2 is a plot illustrating the triboelectric values of carrier particles comprised of a steel core with a one weight percent polymer and composite coating with various ratios or weight percents of polypyrrole-$PVF_2$ ICP dispersed therein.
Figure 3:
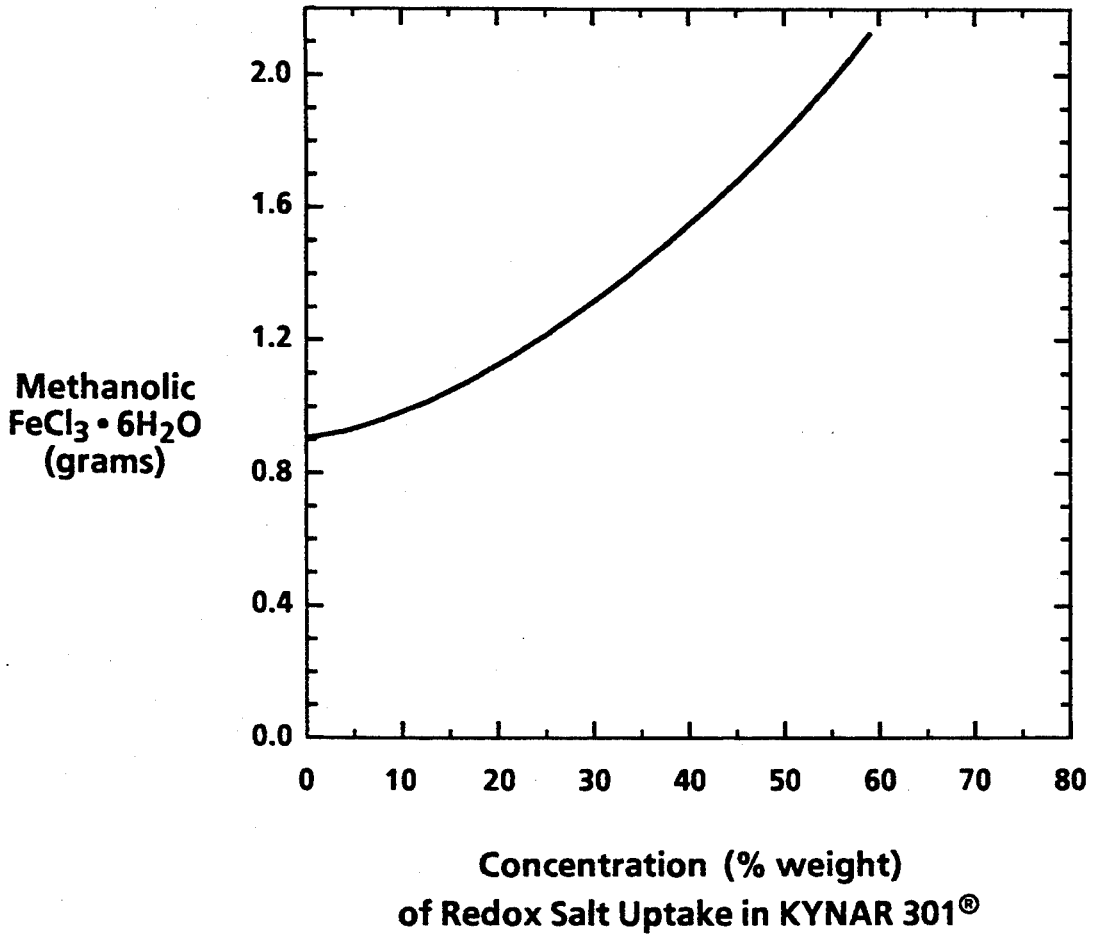
FIG. 3 is a plot illustrating the enhanced imbibation of methanol into colloidal $PVF_2$ powders with increasing concentration of redox salt such as $FeCl_3$.

The present invention provides a process for forming conductive powdered composite compositions which are useful for preparing thermal and oxidatively stable conductive films and coatings. For a better understanding of the present invention, in embodiments, an exemplary outline of steps utilized in preparative processes follows and are shown schematically in FIG. 1: 1. imbibe a redox salt solution into a submicron fluoropolymer powder, for example, $PVF_2$ to form a slurry of the $PVF_2$ powder swollen by the redox salt solution; 2. centrifuge or filter the slurry to yield a soft gel comprised of $PVF_2$ host resin polymer, imbibed redox salt, and solvent; 3. dry the soft gel to form a composite powder comprising $PVF_2$ host resin and imbibed redox salt; 4. slurry the composite powder in, an apolar liquid for example, toluene; 5. add an aromatic or heteroaromatic redox polymerizable monomer to the slurry wherein redox polymerization of monomer ensues to form a conductive polymer product in the amorphous regions of the host fluoropolymer; 6. centrifuge or filter the resultant slurry to yield a wet powder cake; 7. wash the wet cake, with for example toluene; 8. extract the wet powder cake with, for example, an ethereal solvent; 9. optionally wash the resultant product with an ethereal solution of an acid or salt which contains an appropriate counter anion to effect an anion-exchange reaction; and 10. centrifuge or filter the resultant anionic exchanged product to yield a dry powder cake. The optional step 9, is only necessary if one desires a different counter anion at the radical cation sites in the fractionally oxidized ICP rather than the counter ion which is derived from the redox salt used to effect the oxidative coupling polymerization.

In an alternative embodiment of the present invention, the composition of the soft gel of step 2 may be achieved by directly doping the $PVF_2$ powder. The soft gel can then be directly slurried in an apolar liquid, for example, toluene, and an aromatic redox polymerizable monomer added to the slurry wherein in situ redox polymerization of monomer occurs to form a conductive polymer product in the amorphous regions of the host fluoropolymer. This alternative embodiment, indicated in FIG. 1 with the side arm route in the flow diagram labeled "4., 5.," circumvents steps 2 and 3, comprising respectively, centrifugation or filtration of the slurry to yield a soft gel, and drying the gel, thereby eliminating two process steps and associated material handling and transfers.

Examples of suitable fluoropolymers useful in the present invention include vinylidene fluoride homopolymers, vinylidene fluoride-tetrafluoroethylene copolymers, vinylidene fluoride-monofluoroethylene copolymers, vinylidene fluoride-trifluoroethylene copolymers, vinylidene fluoride-hexafluoropropylene copolymers, vinylidene fluoride-monocholorotrifluoroethylene copolymers, multi-component copolymers of vinylidene fluoride, and the like, and mixtures thereof.

Coating of the carrier particles of the present invention may be affected by any suitable process. Powder coating, wherein a dry powder of the coating material is applied to the surface of the carrier particle core and fused to the core by means of heating or irradiating is a preferred method. Another coating method useful in the present invention wherein emission of volatile organic compounds is avoided is the known fluid bed coating process, whereby air or nitrogen gas is used to fluidized a bed of carrier core particles having ICP/$PVF_2$ composite particles absorbed on the surface of the core particles and heated to a temperature sufficient to fuse the host resin and composite composition substantially continuously onto and into the surface of the core particles. Preferred coating weights of the conductive composite on the surface of the carrier particles are disclosed in the aforementioned U.S. Pat. No. 4,937,166.

The toners useful in conjunction with the carrier prepared in the present invention, to form developer compositions, may be prepared by processes such as extrusion, which is a continuous process that comprises dry blending the resin, pigment, and charge control additive, placing them into an extruder, melting and mixing the mixture, extruding the material, and reducing the extruded material to pellet form. The pellets are further reduced in size by grinding or jetting, and are then classified by particle size. External additives such as linear polymeric alcohols, silica, or zinc stearate may then blended with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention. Examples of toners are illustrated in U.S. Pat. Nos. 4,937,157 and 4,904,762, Additionally, specific embodiments of the present invention will now be described in detail. The following examples are intended to be illustrative, and the invention is not limited to the materials, conditions, or process parameters set forth in these embodiments. All parts and percentages are by weight unless otherwise indicated.

EXAMPLE I

Synthesis of $PVF_2$/Poly(thiophene) Colloidal Powders

Thirty grams (30 grams) of colloidal $PVF_2$ powder (KYNAR ®301 R) a uniform white powder containing particles of about 0.3 micrometers in diameter was mixed with 90 grams of a 33% solution of $FeCl_3.(H_2O)_6$ in methanol. This mixture was allowed to steep at ambient temperature for 2 to 4 hours, yielding a gelatinous slurry. The gelatinous slurry was centrifuged (about 15 minutes at 5,000 rpm) to remove excess methanol/-$FeCl_3$ solution, (56 grams). The resultant gelatinous powder was dried, in two steps: first, for about sixteen hours in air at ambient temperature; and then second, for four hours in vacuo at 50° C. to yield 38 grams of a yellow powder comprised of $PVF_2/FeCl_3.(L)_n(79/21)_w$ where L represents a solvation molecule ligand of either $H_2O$ or MeOH and the value of n is believed to be about 6. The $PVF_2/FeCl_3.(L)n(79/21)_w$composite powder was slurried in toluene (about 50 mL) at ambient temperature and 3.7 grams of bithiophene dissolved in toluene was added to the slurry. Poly(thiophene) quickly formed as evidenced by a rapid color change of the slurry from yellow to dark blue particles. The slurry then stood for about 16 hours. Next, the mixture was centrifuged and washed with toluene to remove any unreacted or excess bithiophene. The resulting toluene wet powder was washed with a 1 percent solution of p-toluene sulfonic acid in ether to remove residual ferrous chloride and ion exchange chloride ion and/or tetrachloroferrate ion with the tosylate anion. After removal of ferrous chloride and ion exchange chloride, the blue-black powder was washed with ether to remove any residual p-toluene sulfonic acid. The washed blue-black composite powder, $PVF_2$/[poly(thiophene)3(thiophenium+tosylate-)] was dried, ground and sieved to yield a material suitable for powder coating. The size of the resulting composite particles were essentially the same as that of the precursor $PVF_2$ particles. The composite obtained was conductive. As a qualitative indication of this conductivity, the resistivity of a pressed pellet 2 mm in thickness, was measured to be 650 KΩ.

EXAMPLE II

Synthesis of $PVF_2$/Poly(pyrrole) Colloidal Powders

The procedure of EXAMPLE I was repeated with the exception that, $PVF_2$/poly[(pyrrole)$_3$(pyrrolium+-tosylate-)] conductive powders were prepared by substituting pyrrole for bithiophene. The resulting free flowing powders are coated onto to carrier beads to yield conductive magnetic developers as described in EXAMPLE III.

EXAMPLE III

Powder Coating of Carrier Core

The blue-black powder $PVF_2$/poly[(thiophene)$_3$(thiophenium.+tosylate-)] prepared in EXAMPLE I was blended with carrier core, 90 microns in diameter Hoeganaes iron grit, 1 part of $PVF_2$/poly[(thiophene)$_3$(thiophenium.+tosylate-)] to 99 parts of carrier core in a V-cone blender. The blended composition was placed in an insert, which is a stainless steel cylinder with a capacity of about 5 lbs of carrier core. The insert is closed at both ends except for a small hole to insert a thermocouple. The insert is used for small scale coating evaluation because it requires less material than a full scale kiln run. The insert containing the 1 part of $PVF_2$/poly[(thiophene)$_3$(thiophenium+tosylate-)] to 99 parts of carrier core was inserted into a Harper 5" diameter rotary kiln heated to 400° F. The insert was rotated within the kiln for 30 minutes before being removed. The carrier was removed from the insert and screened through an 84 mesh screen. The polymer easily coated the core under these conditions. There was little material remaining in the insert and no clumping or agglomeration of the polymer coating composite and core. Overall the material processed well, and by visual appearance produced a uniformly coated carrier. Coated core carrier particles were isolated and charging characteristics were evaluated and described in Example IV.

EXAMPLE IV

Conductivity and Charging Characteristics

In a standard 10 minute tribo paint shake charging experiment against a control developer (that is a developer comprised of an uncoated carrier core of Example III and a toner comprised of SPAR II polyester resin, 5 weight percent carbon black and 6 weight percent 660-P wax, that was reactively extruded with benzoyl peroxide to generate a gel content of 30 weight percent) a tribo charge of +15 microcoulombs per gram was developed. When the $PVF_2$/poly[(thiophene)3(thiophenium+tosylate)- coated carrier of Example III was substituted in this developer, a tribo charge of −35 microcoulombs per gram was realized. This demonstrated the effectiveness of the conductive coated carrier prepared in Example III in generating negative triboelectric charging properties and demonstrates the utility of conductive coated carriers of the present invention as a negative contrast carriers. The conductivity of the carrier was about $10^{-8}\,\Omega^{-1}\,cm^{-1}$. This value is in the range desired for coated conductive magnetic brush carriers The disclosures of all the patents and publications mentioned herein are incorporated by reference in their entirety.

Other modifications of the present invention may occur to those skilled in the art subsequent to a review of the present application. The aforementioned modifications, including equivalents thereof, are intended to be included within the scope of the present invention.

TABLE 1

ICP Composite Summary

| ICP Composite[f] | $Fe^{3+}$ Form and Concentration in MeOH | Drying process and state of $PVF_2/FeCl_3$ Composite | Theoretical Yield[a] | Reaction Medium | Resistance[b] |
|---|---|---|---|---|---|
| $PVF_2$/Poly(pyrrole) | 50% $FeCl_3.6(H_2O)$ | slow dry[c] | 11.6 | Toluene | $>5.0 \times 10^8$ |
| | | fast dry[d] | | Toluene | 71 |
| | | slow dry | | Cyclohexane | $3.5 \times 10^4$ |
| | | fast dry | | Cyclohexane | 510 |
| $PVF_2$/Poly(pyrrole) | 45% $FeCl_3.6(H_2O)$ | slow dry | 10.3 | Toluene | $>5.0 \times 10^8$ |
| | | fast dry | | Toluene | 50 |
| | | fast dry | | Cyclohexane | 650 |
| $PVF_2$/Poly(pyrrole) | 40% $FeCl_3.6(H_2O)$ | fast dry | 8.9 | Toluene | $7.0 \times 10^4$ |
| | | slow dry | 8.9 | Toluene | $2.3 \times 10^8$ |
| | | fast dry | | Cyclohexane | 1500 |
| $PVF_2$/Poly(pyrrole) | 35% $FeCl_3.6(H_2O)$ | fast dry | 7.5 | Cyclohexane | 700 |
| $PVF_2$/Poly(pyrrole) | 30% $FeCl_3.6(H_2O)$ | fast dry | 6.9 | Cyclohexane | 1500 |
| PVF2/Poly(pyrrole) | 34% $FeCl_3$ Anhydrous | Gel[e] | 19.5 | Toluene | $>5.0 \times 10^8$ |
| | | slow dry | | Toluene | $1.9 \times 10^7$ |
| $PVF_2$/Poly(3-Methyl thiophene) | 50% $FeCl_3.6(H_2O)$ | slow dry | 12.2 | Toluene | 50 |
| | 50% $FeCl_3.6(H_2O)$ | slow dry | | Cyclohexane | 100 |
| $PVF_2$/Poly(thiophene) dodecylbenzene sulfonate | 34% $FeCl_3$ Anhydrous | slow dry | 17.3 | Toluene | 20 |

[a]The theoretical weight % of fractionally oxidized ICP (inclusive of anion mass) in the composite, based on the amount of $FeCl_3$ imbibed into $PFV_2$.
[b]Resistance in a capacitive geometry of compressed pellets of $PVF_2$/ICP composites, 2 mm in thickness, in Ohms.
[c]Slow dry - methanol evaporated from thick film of treated $PVF_2$, >16 hrs.
[d]Fast dry - methanol evaporated from thin film of treated $PVF_2$, >4 hrs.
[e]Gel - $PVF_2$ swollen to its limit with the specificed methanolic ferric chloride solution.
[f]The ICP is assumed to be fractionally oxidized (one in about four residues) and the oxidized residues are, unless specified otherwise, compensated with a tosylate anion.

What is claimed is:

1. A carrier composition comprised of a core with a coating thereover comprised of a composite comprised of a conductive aromatic or heteroaromatic polymer comprised of a monomer or monomers selected from the group consisting of pyrrole, indole, thiophene, thianaphthene, indene, azulene polymerized in the presence of and ring pendant substitutent derivatives thereof; and a fluoropolymer host resin.

2. A composition according to claim 1, wherein the coating is melt processable and electrically conductive.

3. A composition according to claim 1, wherein the number of monomers in the aromatic or heteroaromatic polymer is from about: 10 to about $10^{10}$.

4. A composition according to claim 1, wherein the number of monomers in the aromatic or heteroaromatic polymer is from about $10^2$ to about $10^6$.

5. A composition according to claim 1, wherein the aromatic or heteroaromatic polymer is crosslinked or networked with a degree of polymerization of from about 10 to about $10^{10}$.

6. A composition according to claim 1, wherein said fluoropolymer host resin comprises from about 30 to about 99 weight percent and the conductive polymer comprises from about 10 to about 70 weight percent of the composite coating weight.

7. A composition according to claim 1, wherein the fluoropolymer host resin is selected from the group consisting of vinylidene fluoride homopolymers, vinylidene fluoride-tetrafluoroethylene copolymers, vinylidene fluoride-monofluoroethylene copolymers, vinylidene fluoride-trifluoroethylene copolymers, vinylidene fluoride-hexafluoropropylene copolymers, vinylidene fluoride-monocholorotrifluoroethylene copolymers and multi-component copolymers of vinylidene fluoride, and mixtures thereof.

8. A composition according to claim 1, wherein said ring pendant substitutent derivatives are selected from the group consisting of alkyl and alkoxy groups with from 1 to about 20 carbon atoms, aryl groups with from 6 to 24 carbon atoms, and carboxyl, cyano, nitro and halogen groups.

9. A composition according to claim 1, wherein the conductive carrier coating composition is melt processable in a temperature range from about 50° C. to about 250° C.

10. A composition according to claim 1, wherein the electrical conductivity thereof is from about $10^{-12}$ to about $10^2$ Siemens per cm (S/cm).

11. A composition according to claim 1, wherein the fluoropolymer host is homopolymeric, copolymeric, or multi-meric.

12. A composition according to claim 1, wherein the fluoropolymer host is present in an amount from about 0.1 to about 5 percent by weight based on the combined weight of the carrier core, fluoropolymer and the conductive aromatic or heteroaromatic polymer.

13. A composition in accordance with claim 1 wherein the core is selected from the group consisting of iron, steel, magnetite, nickel, ferrites, and mixtures thereof.

* * * * *